US008042480B2

(12) United States Patent
Simons

(10) Patent No.: US 8,042,480 B2
(45) Date of Patent: Oct. 25, 2011

(54) ROLL STABILIZER

(75) Inventor: Anthony Paul Simons, Henderson, WA (US)

(73) Assignee: Austal Ships Pty. Ltd. (AU)

( * ) Notice: Subject to any disclaimer, the term of this patent is extended or adjusted under 35 U.S.C. 154(b) by 0 days.

(21) Appl. No.: 12/446,122

(22) PCT Filed: Oct. 24, 2007

(86) PCT No.: PCT/AU2007/001616

§ 371 (c)(1),
(2), (4) Date: Jul. 13, 2010

(87) PCT Pub. No.: WO2008/058309

PCT Pub. Date: May 22, 2008

(65) Prior Publication Data

US 2010/0275830 A1 Nov. 4, 2010

(30) Foreign Application Priority Data

Nov. 17, 2006 (AU) ..... 2006906428

(51) Int. Cl.
*B63B 39/06* (2006.01)

(52) U.S. Cl. ..... 114/126

(58) Field of Classification Search ..... 114/126; 440/112

See application file for complete search history.

(56) References Cited

U.S. PATENT DOCUMENTS 2,670,159 A * 2/1954 Barr ..... 244/101
3,080,845 A 3/1963 Pollak
3,618,553 A * 11/1971 Ehluss ..... 114/126
4,023,516 A * 5/1977 Bennett ..... 114/126
4,273,063 A 6/1981 Berne
4,475,777 A * 10/1984 Hofmann et al. ..... 384/572
5,042,319 A * 8/1991 Hobock et al. ..... 74/570.3
5,681,117 A * 10/1997 Wellman et al. ..... 384/441
5,944,429 A * 8/1999 Berry ..... 384/506

FOREIGN PATENT DOCUMENTS

GB 829821 3/1960

* cited by examiner

*Primary Examiner* — Stephen Avila

(74) *Attorney, Agent, or Firm* — Ostrolenk Faber LLP

(57) ABSTRACT

A roll stabilizer (10) is disclosed which comprises a fixed fin portion (12) connected during use to a hull of a vessel so as to extend outwardly of the hull in a substantially non-vertical direction, a flap portion (14) rotatable relative to the fixed fin portion (12), the orientation of the flap portion (14) relative to the fixed fin portion defining the degree of roll stabilizing force generated by the roll stabilizer (10), a shaft (16) connected to the flap portion (14) and extending during use through a vessel hull, a seal assembly (41) arranged to facilitate rotation of the shaft (16) while maintaining water tight integrity, and a first split bearing (18) disposed during use in a vessel hull on the shaft (16). The first split bearing (18) facilitates rotation of the flap portion (14) and comprises a first bearing portion (56), a second bearing portion (58) and operative bearing components (59), wherein access to the operative bearing components (59) and the seal assembly (41) is obtainable by separating the first and second bearing portions from each other.

14 Claims, 5 Drawing Sheets

ROLL STABILIZER

FIELD OF THE INVENTION

The present invention relates to a roll stabilizer for a marine vessel.

BACKGROUND OF THE INVENTION

It is known to provide marine vessels with roll stabilizers in the form of fins which extend in a non-vertical orientation, the roll stabilizers being controllably rotatable so as to generate hydrodynamic forces perpendicular to the direction of travel as the vessel moves through the water. The roll stabilizers are controlled so that the forces act in the direction opposite to the direction in which the vessel is rolling and as a consequence serve to stabilize the vessel by counteracting the roll.

Roll stabilizing forces are commonly generated either by rotating an entire fin or by providing a fixed fin portion and a flap portion rotatable relative to the fixed fin portion.

However, since roll stabilizers are required to be always disposed in the water, the roll stabilizers are difficult to access for maintenance, and hitherto it has generally been necessary to remove the ship from the water by slipping or dry docking in order to access the roll stabilizers. Facilities for dry docking relatively large marine vessels are scarce, and dry docking a marine vessel is relatively time consuming and expensive.

For relatively large marine vessels, relatively large and heavy roll stabilizers are required and as a consequence it is impractical to employ underwater divers to carry out maintenance of the roll stabilizers with the vessel afloat. In addition, roll stabilizers can generally not be removed from a marine vessel while the marine vessel is afloat because removal of a roll stabilizer would breach the watertight integrity of the vessel.

Moreover, roll stabilizers known hitherto often include a hinged connection between the rotatable flap portion and the fixed fin portion, thus making maintenance on the hinge bearings extremely difficult.

SUMMARY OF THE INVENTION

In accordance with a first aspect of the present invention, there is provided a roll stabilizer comprising:

a fixed fin portion connected during use to a hull of a vessel so as to extend outwardly of the hull in a substantially non-vertical direction;

a flap portion rotatable relative to the fixed fin portion, the orientation of the flap portion relative to the fixed fin portion defining the degree of roll stabilizing force generated by the roll stabilizer;

a shaft connected to the flap portion and extending during use through a vessel hull;

a seal assembly arranged to facilitate rotation of the shaft while maintaining water tight integrity; and a first split bearing disposed during use in a vessel hull on the shaft, the first split bearing facilitating rotation of the flap portion and comprising a first bearing portion, a second bearing portion and operative bearing components, wherein access to the operative bearing components and the seal assembly is obtainable by separating the first and second bearing portions from each other.

In one embodiment, the roll stabilizer further comprises a second split bearing disposed during use in a vessel hull on the shaft, the second split bearing facilitating rotation of the flap portion and comprising a first bearing portion, a second bearing portion and operative bearing components, wherein access to the operative bearing components is obtainable by separating the first and second bearing portions from each other.

The seal assembly may comprise at least one annular seal which may be at least one lip seal.

The seal assembly may also comprise an inflatable seal arranged such that when the inflatable seal is inflated, a watertight seal is provided between the vessel hull and surrounding water so that components of the seal assembly can be replaced without compromising the watertight integrity of the vessel.

In one arrangement, the seal assembly also includes a clearance installation support bearing arranged so as to allow the shaft to be inserted or withdrawn without damaging the inflatable seal.

In one arrangement, the roll stabilizer further comprises a flange integral with the fixed fin portion, the flange being fixable to a vessel hull, for example using bolts or by welding.

In one arrangement, the first split bearing is of flanged type fixable to the flange of the fixed fin portion or an internal surface of a vessel hull, and the second split bearing is of pedestal type.

In one embodiment, the roll stabilizer further comprises an end bearing disposed at an end of the flap portion remote from the vessel hull during use. The roll stabilizer may further comprise a bearing support member which may be in the form of an end plate fixable to the fixed fin portion, the end bearing being receivable in the bearing support member and being accessible for maintenance by removing the bearing support member.

Since no direct connection exists between the flap portion and the fixed fin portion in a region between the flange and the remote end of the flap portion, difficult and cumbersome maintenance is avoided.

The end bearing may comprise a water lubricated bearing.

In one arrangement, the shaft is integrally formed with the flap portion.

In accordance with a second aspect of the present invention, there is provided a roll stabilizer comprising:

a fixed fin portion connected during use to a hull of a vessel so as to extend outwardly of the hull in a substantially non-vertical direction;

a flap portion rotatable relative to the fixed fin portion, the orientation of the flap portion relative to the fixed fin portion defining the degree of roll stabilizing force generated by the roll stabilizer;

a shaft connected to the flap portion and extending during use through a vessel hull; and an end bearing disposed at an end of the flap portion remote from the vessel hull during use, the end bearing facilitating rotation of the flap portion.

The roll stabilizer may be arranged such that rotation of the flap portion relative to the fixed fin portion is facilitated without a hinge connection between the flap portion and the fixed fin portion. During use, the end bearing may be the only bearing disposed outwardly of the vessel hull.

In accordance with a third aspect of the present invention, there is provided a vessel comprising a roll stabilizer according to the first aspect of the present invention.

BRIEF DESCRIPTION OF THE DRAWINGS

The present invention will now be described, by way of example only, with reference to the accompanying drawings, in which.

DESCRIPTION OF AN EMBODIMENT OF THE INVENTION

Figure 1:
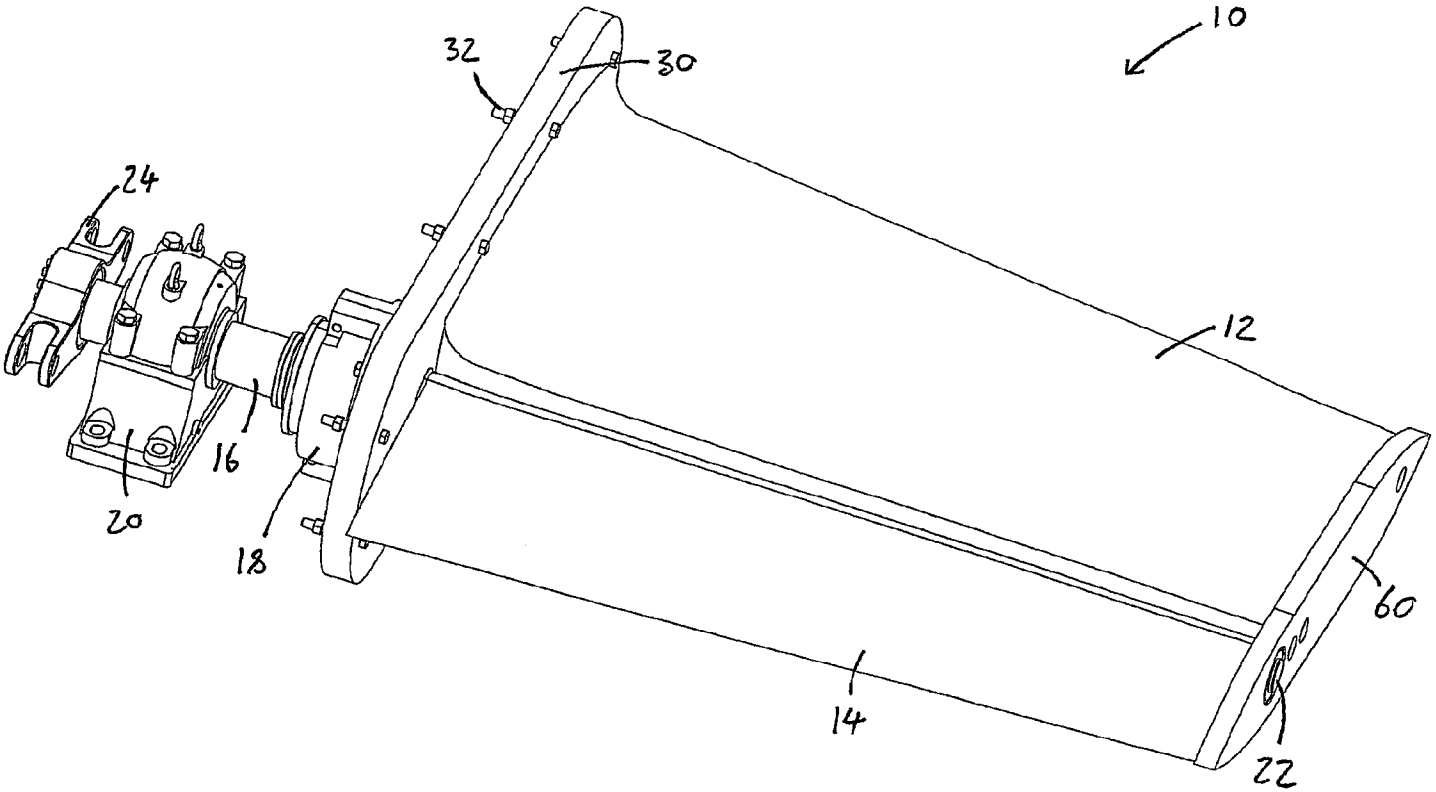
FIG. 1 is a diagrammatic perspective view of a roll stabilizer in accordance with an embodiment of the present invention.

Referring to the drawings, there is shown a roll stabilizer 10 for a marine vessel, the roll stabilizer 10 being connected during use to a hull of a vessel so that the roll stabilizer 10 is disposed in a generally non vertical orientation. The roll stabilizer 10 is usable to apply a user controlled roll stabilizing force to the vessel.

The roll stabilizer 10 includes a fixed fin portion 12 and a flap 14 pivotable relative to the fin portion 12 about a shaft 16. In this example, the shaft 16 is integrally formed with the flap 14, although it will be understood that other arrangements are envisaged. For example, the shaft 16 may be formed separately to the flap 14 and fixed to the flap 14 for example by welding.

The roll stabilizer 10 also includes a first split bearing 18, a second split bearing 20, and an end bearing 22 which facilitate rotation of the flap 14. In this example, an end of the shaft 16 remote from the flap 14 is provided with a drive connection 24 which may be any suitable mechanism for receiving a driving force and effecting rotation of the flap 14 relative to the fin portion 12.

Figure 5:
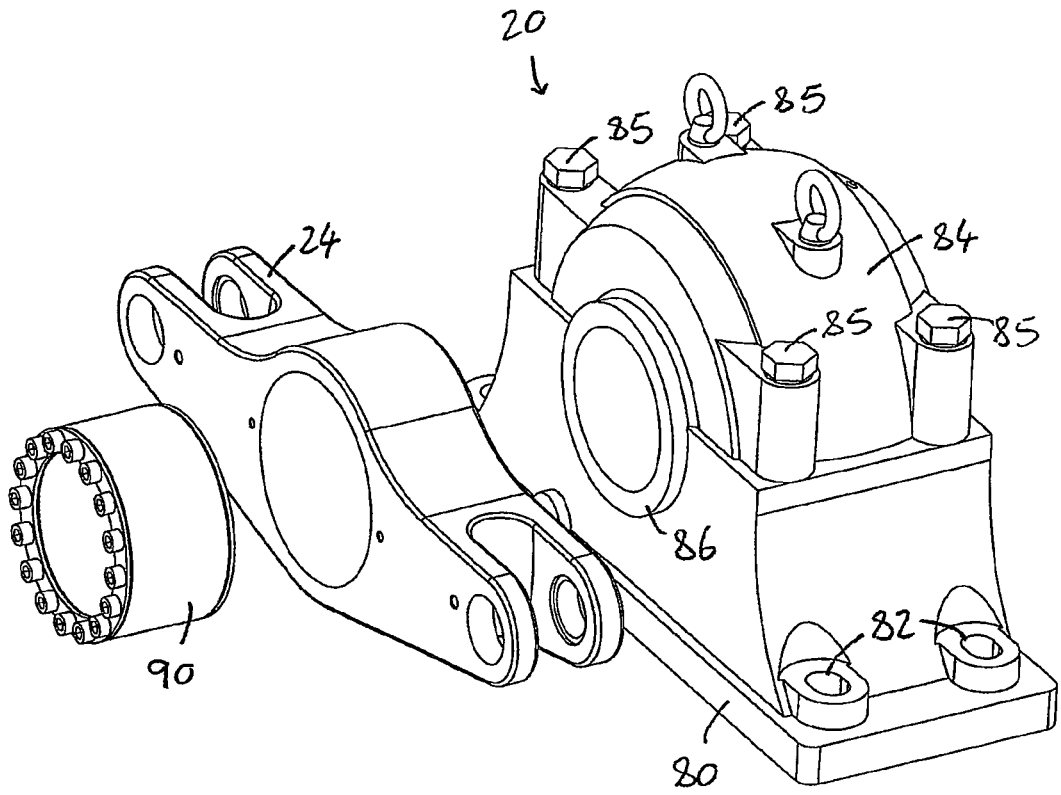
FIG. 5 is a diagrammatic perspective view of a second split bearing and a drive connection of the roll stabilizer shown in FIG. 1.

In the present example, the drive connection 24 includes a drive collar 90, shown in FIG. 5, which grips the shaft 16 during use.

Integral with the fixed fin portion 12 is a flange 30 which facilitates connection of the roll stabilizer 10 to an external surface of a hull of a marine vessel using bolts 32 or by welding. It will be understood that by fixing the flange 30 to the vessel hull using bolts 32, the likelihood of failure of the join between the flange 30 and the vessel hull due to relatively large forces exerted by the surrounding water during use is minimized. Fixing the flange 30 to the vessel using bolts also allows removal of the flange 30 and the fixed fin portion 12.

As shown in FIG. 1 of the drawings, the first split bearing 18 is disposed adjacent the flange 30, in this example bolted directly to the flange 30, the second split bearing 20 is disposed between the first split bearing 18 and the drive connection 24, and the end bearing 22 is disposed at an end of the fin portion 12 remote from the flange 30.

It will be understood that for clarity, the vessel hull has been omitted from some of the drawings.

Figure 3:
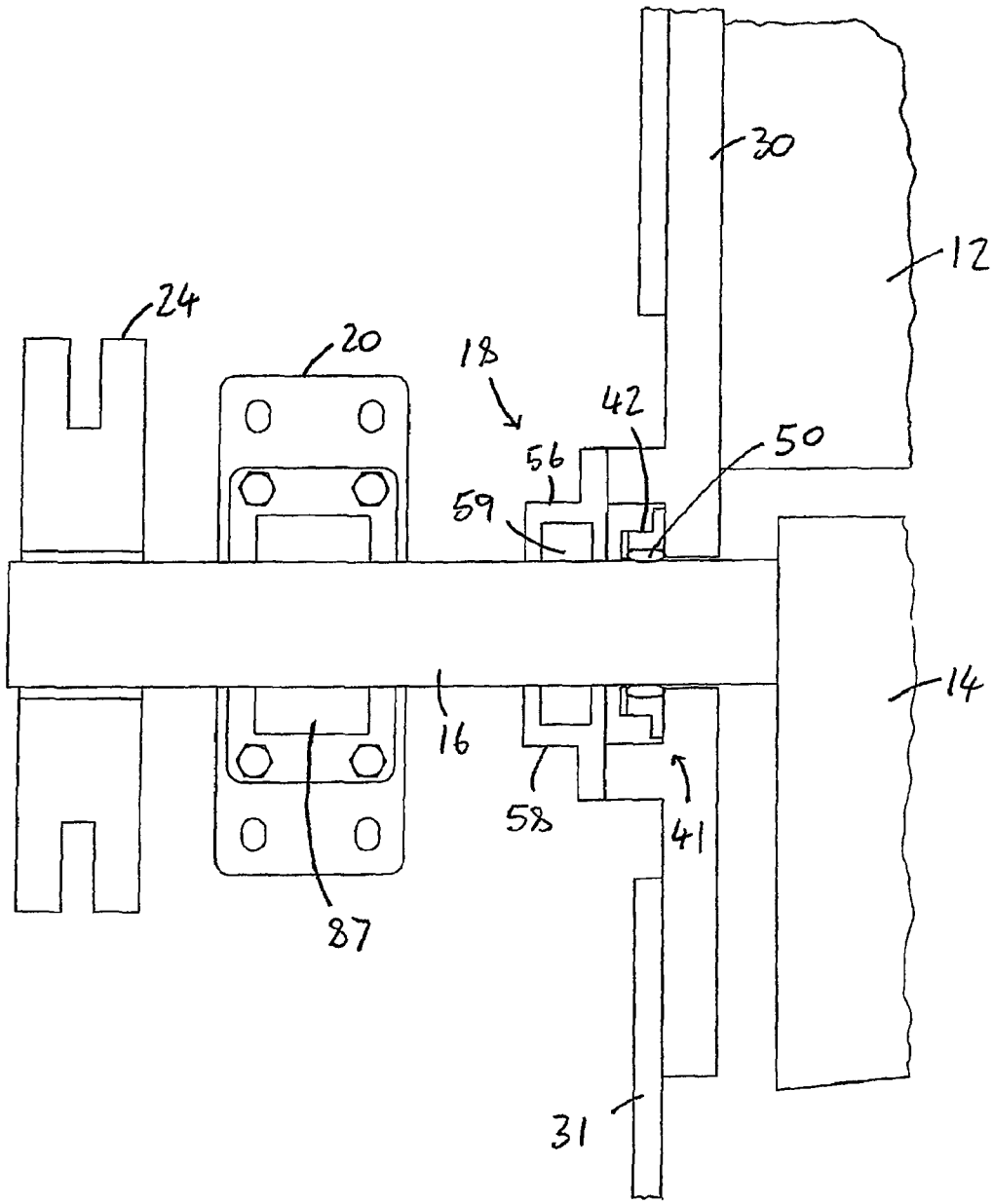
FIG. 3 is a diagrammatic cross-sectional representation of the first split bearing shown in FIG. 2.

During use, when the roll stabilizer 10 is fixed to a vessel hull foundation plate 31 shown in FIG. 3, the foundation plate 31 will be disposed inboard of the flange 30 and the first split bearing 18 will pass through a hole in the foundation plate 31.

Figure 2:
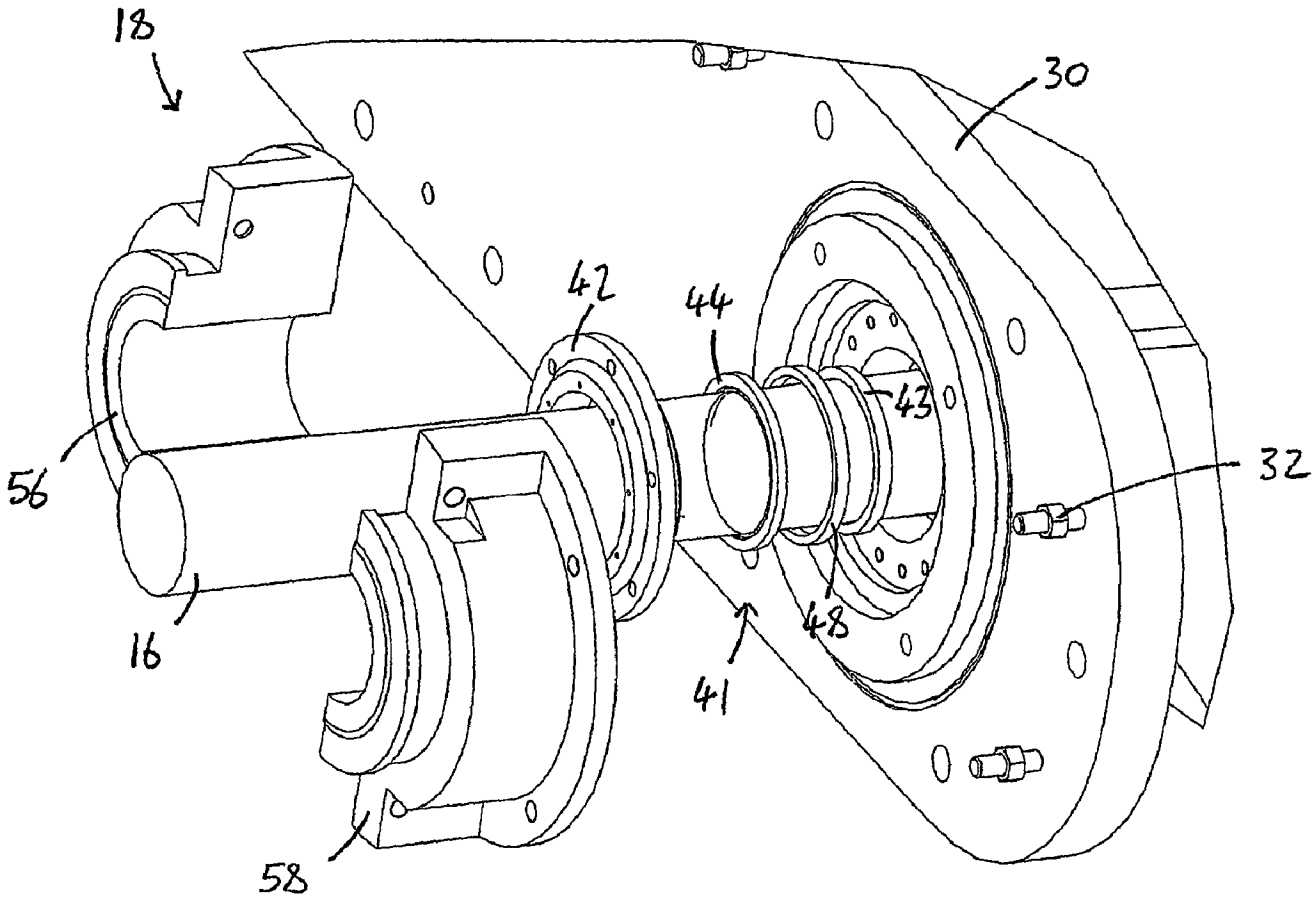
FIG. 2 is a diagrammatic perspective partially exploded view of a first split bearing of the roll stabilizer shown in FIG. 1.

As shown more particularly in FIGS. 2 and 3, the roll stabilizer 10 also includes a seal assembly 41 which permits the shaft 16 to rotate whist maintaining water tight integrity of the vessel The seal assembly 41 comprises a seal housing 42, and operative components 50 including a water lubricated clearance installation support bearing 43, annular lip seals 44, and an inflatable seal 48. The seal housing 42 is fixed to the flange 30 in any suitable way, for example using bolts.

The first split bearing 18 includes a first bearing member 56 and a second bearing member 58 which are disposable around the shaft 16 and are fixable to each other and to the flange 30 for example using bolts.

The first split bearing 18 also includes operative components 59 which facilitate rotation of the shaft 16 and thereby the flap 14 relative to the fin portion 12.

It will be understood that by providing first and second bearing members 56, 58 in a split configuration and by disposing the first split bearing inside the vessel hull, ease of maintenance of the first split bearing 18 and the seal assembly 41 is facilitated. This is because access to the operative components 59 of the first split bearing 18 and operative components 50 of the seal assembly 41 can be gained simply by disconnecting the first and second bearing members 56, 58 from each other and from the flange 30.

During use, in order to carry out maintenance on the seal assembly 41, the first and second bearing members 56, 58 are removed and the inflatable seal 48 is inflated so as to provide a temporary watertight seal. The seal housing 42 can then be removed and the lip seals 44 replaced. The clearance installation support bearing 43 allows the shaft 16 to be inserted or withdrawn without damaging the inflatable seal 48. After replacement of the lip the first and second bearing members 56, 58 can be reconnected to each other and to the flange 30. The inflatable seal 48 can then be deflated.

It will be understood that the invention is not restricted to the above split bearing configuration, the important aspect being that a suitable split bearing is provided which is able to facilitate rotation of the shaft 16 while being capable of enabling access to operative components of the bearing and/or seal assembly by separating potions of the bearing in a split-type configuration.

Figure 4:
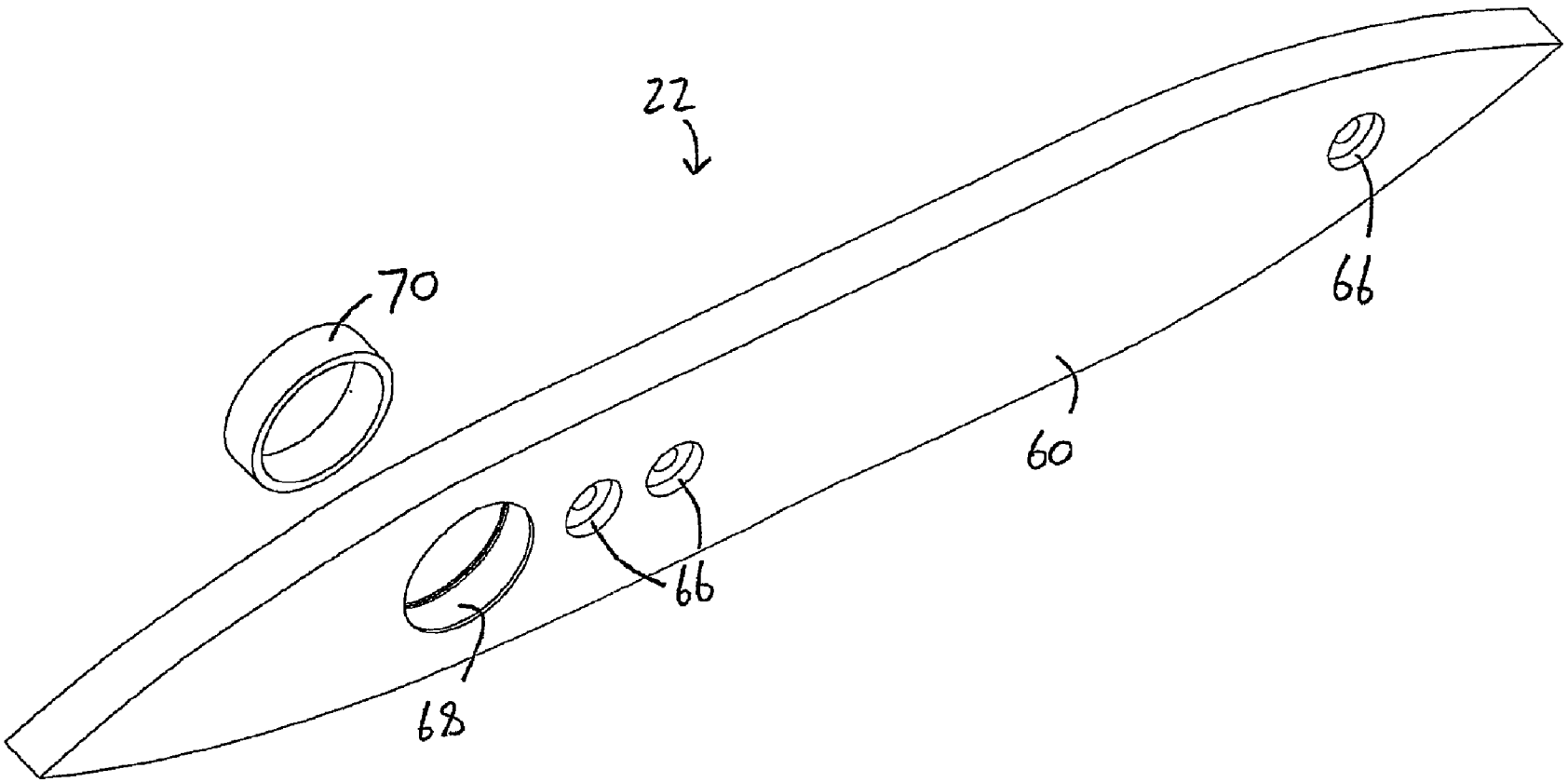
FIG. 4 is a diagrammatic perspective exploded view of an end bearing of the roll stabilizer shown in FIG. 1.

As shown more particularly in FIG. 4, the end bearing 22 in this example comprises a bearing support member 60 in the form of an end plate fixed to the fin portion 12 for example by passing bolts through fixing apertures 66 provided in the bearing support member.

The bearing support member 60 includes a bearing aperture 68 which during use receives operative components of the end bearing 22. The operative components in this example comprise a water lubricated bearing 70.

The end bearing 22 receives the shaft 16 and facilitates rotation of the shaft 16 relative to the bearing support member 60. As such, any bearing arrangement suitable for this purpose is envisaged, the important aspect being that the end bearing is accessible for maintenance purposes by removing the bearing support member 60 or a section thereof.

The end bearing 22 serves to locate the flap 14 relative to the fixed fin and to spread loads exerted on the flap during use.

As shown more particularly in FIG. 5, the second split bearing 20 is of pedestal configuration and includes a pedestal base 80 having fixing apertures 82 usable to fix the second split bearing 20 to a structure inside the hull of a vessel.

The second split bearing 20 includes a pedestal cap 84 which is separable from and connectable to the pedestal base 80 using bolts 85.

The second split bearing 20 also includes a cylindrical portion 86 which receives the shaft 16 during use and which is rotatable relative to the pedestal base 80 and pedestal cap 84.

In order to access operative components 87 of the second split bearing 20, the bolts 85 are removed and the pedestal cap 84 is disengaged from the pedestal base 80.

During use, the second split bearing 20 facilitates rotation of the shaft 16 relative to the pedestal base 80 and the pedestal cap 84 while facilitating ease of access to the operative components 87 of the second split bearing 20 by virtue of the split configuration of the second split bearing 20.

It will be understood that the invention is not restricted to the above split bearing configuration, the important aspect being that a suitable split bearing is provided which is able to facilitate rotation of the shaft 16 while being capable of enabling access to operative components of the bearing by separating potions of the bearing in a split-type configuration.

It will be appreciated that since both first and second bearings 18, 20 are split bearings and are disposed during use in a vessel hull, it becomes possible to carry out maintenance on bearings of the roll stabilizer 10 without the need to dry dock the marine vessel.

It will also be appreciated that since the end bearing 22 is disposed at a remote end of the fin portion 12, in this example within a removable bearing support member 60, maintenance can be easily carried out on the end bearing 22 by a diver, in particular because the bearing support member 60 is of sufficiently light weight for practical handling. By providing an end bearing, it is possible to enable rotation of the flap 14 without the need to provide a hinge connection between the flap and the fixed fin portion 12. This is particularly advantageous since difficult maintenance on the hinge bearings is avoided.

Modifications and variations as would be apparent to a skilled addressee are deemed to be within the scope of the present invention.

The invention claimed is:

1. A roll stabilizer comprising:

a fixed fin portion connected during use to a hull of a vessel so as to extend outwardly of the hull in a substantially non-vertical direction;

a flap portion rotatable relative to the fixed fin portion, the orientation of the flap portion relative to the fixed fin portion defining the degree of roll stabilizing force generated by the roll stabilizer;

a shaft connected to the flap portion and extending during use through a vessel hull;

a seal assembly arranged to facilitate rotation of the shaft while maintaining water tight integrity; and a first split bearing disposed during use in a vessel hull on the shaft, the first split bearing facilitating rotation of the flap portion and comprising a first bearing portion, a second bearing portion and first operative bearing components, wherein access to the first operative bearing components and the seal assembly is obtainable by separating the first and second bearing portions from each other.

2. A roll stabilizer as claimed in claim 1, further comprising a second split bearing disposed during use in a vessel hull on the shaft, the second split bearing facilitating rotation of the flap portion and comprising a first bearing portion, a second bearing portion and second operative bearing components, wherein access to the second operative bearing components is obtainable by separating the first and second bearing portions from each other.

3. A roll stabilizer as claimed in claim 1, wherein the seal assembly comprises at least one annular seal.

4. A roll stabilizer as claimed in claim. 3, wherein the at least one annular seal comprises at least one lip seal.

5. A roll stabilizer as claimed in claim 1, wherein the seal assembly comprises an inflatable seal arranged such that during use when the inflatable seal is inflated, a watertight seal is provided between the vessel hull and surrounding water so that components of the seal assembly can be replaced without compromising the watertight integrity of the vessel.

6. A roll stabilizer as claimed in claim 5, wherein the seal assembly comprises a clearance installation support bearing arranged so as to allow the shaft to be inserted or withdrawn without damaging the inflatable seal.

7. A roll stabilizer as claimed in claim 1, further comprising a flange connected to the fixed fin portion, the flange being fixable to a vessel hull.

8. A roll stabilizer as claimed in claim 1, wherein the first split bearing is of flanged type.

9. A roll stabilizer as claimed in claim 2, wherein the second split bearing is of pedestal type.

10. A roll stabilizer as claimed in claim 1, further comprising an end bearing disposed at an end of the flap portion remote from the vessel hull during use.

11. A roll stabilizer as claimed in claim 10, further comprising an end plate fixable to the fixed fin portion, the end bearing being receivable in the end plate and the end bearing being accessible for maintenance by removing the end plate.

12. A roll stabilizer as claimed in claim 11, wherein the roll stabilizer is arranged such that rotation of the flap portion relative to the fixed fin portion is facilitated without a hinge connection between the flap portion and the fixed fin portion.

13. A roll stabilizer as claimed in claim 12, wherein during use the end bearing is the only bearing disposed outwardly of the vessel hull.

14. A vessel comprising a roll stabilizer as claimed in claim 1.

* * * * *